US010137685B2

(12) United States Patent
Nakakubo et al.

(10) Patent No.: US 10,137,685 B2
(45) Date of Patent: Nov. 27, 2018

(54) LIQUID DISCHARGE HEAD AND LIQUID DISCHARGE APPARATUS HAVING COVER MEMBER WITH ENHANCED RIGIDITY

(71) Applicant: CANON KABUSHIKI KAISHA, Tokyo (JP)

(72) Inventors: Toru Nakakubo, Kawasaki (JP); Shingo Okushima, Kawasaki (JP); Satoshi Kimura, Kawasaki (JP); Takuya Iwano, Inagi (JP); Akira Yamamoto, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/584,503

(22) Filed: May 2, 2017

(65) Prior Publication Data

US 2017/0326875 A1 Nov. 16, 2017

(30) Foreign Application Priority Data

May 16, 2016 (JP) ..... 2016-097942

(51) Int. Cl.
*B41J 2/14* (2006.01)
*B41J 2/165* (2006.01)
(Continued)

(52) U.S. Cl.
CPC ..... *B41J 2/14* (2013.01); *B41J 2/16505* (2013.01); *B41J 2/04535* (2013.01); *B41J 2/16* (2013.01);
(Continued)

(58) Field of Classification Search
CPC ..... B41J 2/18; B41J 2/16504; B41J 2/1433; B41J 2202/12
See application file for complete search history.

(56) References Cited

U.S. PATENT DOCUMENTS 7,789,499 B2 9/2010 Iwanaga et al.
8,157,356 B2 4/2012 Yamamoto et al.
(Continued)

FOREIGN PATENT DOCUMENTS

JP 2015-174385 A 10/2015
JP 2016-000489 A 1/2016

OTHER PUBLICATIONS

U.S. Appl. No. 15/383,204, Shingo Okushima Seiichiro Karita Takatsuna Aoki Noriyasu Nagai Eisuke Nishitani Yumi Komamiya, filed Dec. 19, 2016.
(Continued)

*Primary Examiner* — Juanita D Jackson
(74) *Attorney, Agent, or Firm* — Fitzpatrick, Cella, Harper & Scinto

(57) ABSTRACT

A cover member includes two end regions located at two ends in a first direction, and two beam portions which extend in the first direction and connect the two end regions together and which, together with the two end regions, form a single opening that exposes a plurality of discharge ports. When a width of the opening is denoted as a [mm], a minimum length in the first direction of the end regions is denoted as c [mm], a modulus of longitudinal elasticity of the cover member is denoted as E [GPa], and a thickness of the cover member is denoted as t [mm], the following expression is established:

$$c \geq \frac{10\left(\frac{a}{25}\right)^4}{\left(\frac{t}{0.3}\right)^3\left(\frac{E}{200}\right)}.$$

14 Claims, 12 Drawing Sheets

(51) Int. Cl.
*B41J 2/045* (2006.01)
*B41J 2/16* (2006.01)

(52) U.S. Cl.
CPC .... *B41J 2/1637* (2013.01); *B41J 2002/14467* (2013.01)

(56) References Cited

U.S. PATENT DOCUMENTS

| | | | | |
|---|---|---|---|---|
| 9,221,257 | B2 | 12/2015 | Moriya et al. | |
| 9,308,725 | B2 | 4/2016 | Togashi | |
| 9,393,783 | B2 | 7/2016 | Togashi | |
| 9,457,566 | B2 | 10/2016 | Kuroda et al. | |
| 2012/0229570 | A1* | 9/2012 | Kobayashi | B41J 2/14233 347/47 |
| 2015/0197089 | A1 | 7/2015 | Karita et al. | |
| 2016/0288500 | A1 | 10/2016 | Togashi | |

OTHER PUBLICATIONS

U.S. Appl. No. 15/388,430, Shingo Okushima Seiichiro Karita Takatsuna Aoki Noriyasu Nagai Eisuke Nishitani Yoshiyuki Nakagawa, filed Dec. 22, 2016.
U.S. Appl. No. 15/388,792, Shingo Okushima Takatsuna Aoki Seiichiro Karita Noriyasu Nagai Tamaki Sato Tetsushi Ishikawa Yasuaki Tominaga Manabu Otsuka Shuzo Iwanaga Tatsurou Mori Kazuhiro Yamada Akira Yamamoto Zentaro Tamenaga Akio Saito, filed Dec. 22, 2016.
U.S. Appl. No. 15/390,847, Shingo Okushima Seiichiro Karita Takatsuna Aoki Noriyasu Nagai, filed Dec. 27, 2016.
U.S. Appl. No. 15/485,648, Shingo Okushima Seiichiro Karita Takatsuna Aoki Noriyasu Nagai, filed Apr. 12, 2017.
U.S. Appl. No. 15/598,677, Zentaro Tamenaga Shuzo Iwanaga Shingo Okushima, filed May 18, 2017.

* cited by examiner

LIQUID DISCHARGE HEAD AND LIQUID DISCHARGE APPARATUS HAVING COVER MEMBER WITH ENHANCED RIGIDITY

BACKGROUND OF THE INVENTION

Field of the Invention

The present invention relates to a liquid discharge head that discharges a liquid such as ink, and to a liquid discharge apparatus that includes such the liquid discharge head.

Description of the Related Art

In recent years, liquid discharge apparatuses are being used as printers for high-speed commercial printing as well as for business uses. When using the liquid discharge apparatuses for such purposes, a line head (a page-wide type liquid discharge head) in which recording element substrates are arrayed across the entire width of a recording medium is used to increase the printing speed. A recording element substrate is mainly manufactured from a silicon wafer or the like, and a substrate whose length is between approximately 10 mm to 40 mm is used in consideration of the yield and the like. Therefore, to construct a line head, it is necessary to arrange a plurality of recording element substrates in the width direction of the recording medium. A staggered arrangement system (Japanese Patent Application Laid-Open No. 2016-000489) and an inline arrangement system (Japanese Patent Application Laid-Open No. 2015-174385) are known as systems for arranging recording element substrates. In the staggered arrangement system, adjacent recording element substrates are arranged in an alternately staggered manner in a conveyance direction of the recording medium. In the inline arrangement system, adjacent recording element substrates are arranged in a straight line.

It is widely known that in order to prevent liquid inside a liquid discharge head from vaporizing and then thickening and coagulating in a liquid discharge apparatus when ink is not being discharged, it is effective to cover the discharge ports with a cap member. The vapor pressure around the discharge ports can be maintained in a saturated state by the cap member, and the amount of evaporation of liquid from the discharge ports when ink is not being discharged can be reduced.

In Japanese Patent Application Laid-Open No. 2015-174385, it is disclosed that a cover member (stationary plate) provided on a face that is opposed to a recording medium of a liquid discharge head has an opening that exposes discharge ports. When a cap member is brought into contact with the cover member, the flatness of the contacting portion can be maintained and the airtightness can be increased. The cover member includes a beam that extends between recording element substrates.

When separating the cap member from the cover member after the cap member has been brought into contact with the cover member, the cover member receives a force from the cap member which is a force in a direction that will cause the cover member to peel off from the liquid discharge head. To withstand this force, it is desirable for the cover member to be difficult to deform, that is, for the cover member to have a high degree of rigidity. The shape of the opening in the cover member differs between a staggered arrangement system and an inline arrangement system, and although a difference exists between the respective rigidities that is attributable to the difference between the shapes of the opening, it is desirable for the cover member to have a high degree of rigidity in each of these kinds of arrangement systems. Although the beam described in Japanese Patent Application Laid-Open No. 2015-174385 has an effect of increasing the rigidity of the cover member, there is a possibility that the beam will widen a space between recording element substrates and result in an increase in the size of the liquid discharge head.

SUMMARY OF THE INVENTION

One aspect of the present invention is directed to providing a liquid discharge head which is equipped with a cover member having a high degree of rigidity and which facilitates miniaturization.

According to one aspect of the present invention, there is provided a liquid discharge head including a recording element substrate having a discharge port forming face in which a plurality of discharge ports which form at least one row and which discharge a liquid are formed; and a cover member which has a longitudinal shape in a first direction and which covers one part of the discharge port forming face. The cover member has two end regions being located at two ends in the first direction, and two beam portions which extend in the first direction and connect the two end regions together and which, together with the two end regions, form a single opening that exposes the plurality of discharge ports. When a width of the opening in a second direction that is orthogonal to the first direction is denoted as a [mm], a minimum length in the first direction of the end regions is denoted as c [mm], a modulus of longitudinal elasticity of the cover member is denoted as E [GPa], and a thickness of the cover member is denoted as t [mm], the following expression is established:

$$c \geq \frac{10\left(\frac{a}{25}\right)^4}{\left(\frac{t}{0.3}\right)^3\left(\frac{E}{200}\right)}.$$

By making the minimum length c of the end regions equal to or greater than a predetermined value in accordance with the width a of the opening, and the modulus of longitudinal elasticity E and the thickness t of the cover member, sufficient rigidity can be imparted to the cover member. Further, because only one opening is formed in the cover member, the influence of the opening on the size of the liquid discharge head is also suppressed.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Hereunder, several exemplary embodiments of the present invention are described using the accompanying drawings. The exemplary embodiments described hereunder are not intended to limit the scope of the present invention. Although in a liquid discharge head according to the present exemplary embodiments, a thermal system is adopted in which air bubbles are generated by heat generating elements to discharge ink, the present invention can also be applied to liquid discharge heads in which a piezo system or various other kinds of fluid discharge systems are adopted. Although the liquid discharge head of the present exemplary embodiments discharges ink, the present invention can also be applied to a liquid discharge head which discharges a liquid other than ink. Although a liquid discharge apparatus according to the present exemplary embodiments circulates ink between an ink tank and a liquid discharge head by a pressure difference, the liquid discharge apparatus may circulate ink by another method or need not circulate ink.

In the following description, a width direction of a recording medium is referred to as "first direction X" and a conveyance direction of a recording medium is referred to as "second direction Y". The first direction X and the second direction Y are orthogonal to each other. Although the present invention can be favorably applied to a line head, it is also possible to apply the present invention to a liquid discharge head that is mounted on a carriage which moves in the width direction of a recording medium. In this case, the first direction X may match the conveyance direction of the recording medium, and the second direction Y may match the width direction of the recording medium. A direction in which discharge ports are arranged or a direction in which a discharge port row extends is referred to as "discharge port row direction". In the present exemplary embodiments, although the discharge port row direction inclines slightly relative to the first direction X, the discharge port row direction may match the first direction X.

(Description of Liquid Discharge Apparatus)

Figure 1:
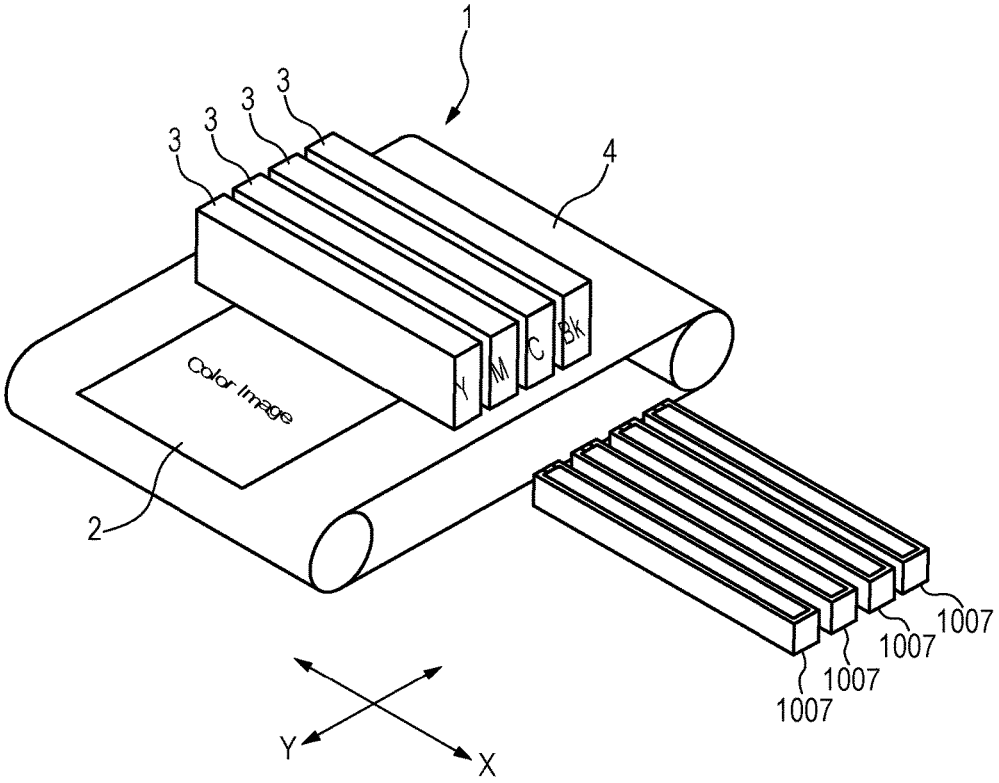
FIG. 1 is a conceptual diagram of a liquid discharge apparatus according to one exemplary embodiment of the present invention.

FIG. 1 shows a conceptual diagram of a liquid discharge apparatus according to one exemplary embodiment of the present invention. A liquid discharge apparatus 1 includes four liquid discharge heads 3 for single colors that correspond to inks for CMYK (cyan, magenta, yellow, black (Bk)), respectively, and performs full-color recording on a recording medium 2 that is conveyed in the second direction Y by conveying unit 4. The four liquid discharge heads 3 are arranged along the second direction Y. Each liquid discharge head 3 has 20 discharge port rows, and extremely high speed recording is enabled by distributing the recording data among a plurality of discharge port rows and performing recording. When ink is not discharged from some discharge ports, the discharge of ink is performed interpolatively from discharge ports of another discharge port row that is at the same position in the first direction X, and therefore the printing reliability is enhanced, and this configuration is favorable for commercial printing and the like. In the present invention, the number of discharge port rows is not limited, and it is sufficient that the discharge ports of each liquid discharge head 3 form at least one row. The liquid discharge apparatus 1 has cap members 1007 that correspond to the respective liquid discharge heads 3.

(Description of Ink Circulation Route)

Figure 2:
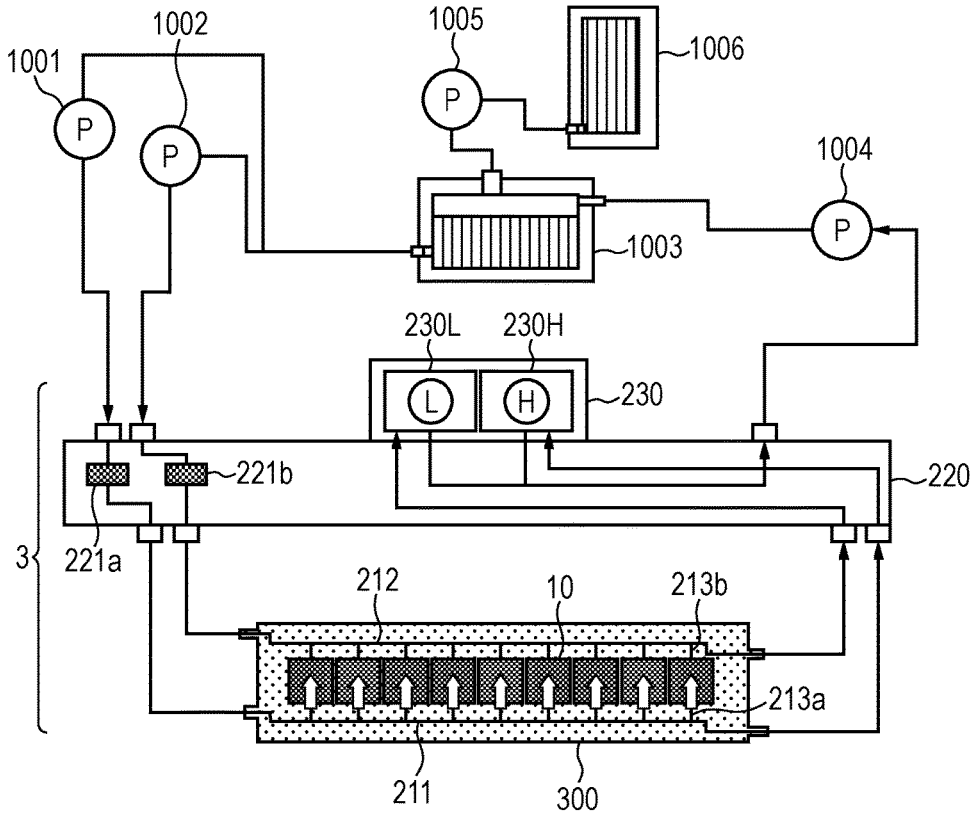
FIG. 2 is a schematic view illustrating a circulation route of ink in the liquid discharge apparatus shown in FIG. 1.

FIG. 2 is a schematic view illustrating a circulation route of ink in the liquid discharge apparatus 1. Although the circulation route of ink of one of the liquid discharge heads 3 is illustrated in FIG. 2, the circulation route is the same for the other liquid discharge heads 3.

A first circulation pump (high pressure side) 1001 and a first circulation pump (low pressure side) 1002 are disposed on the upstream side of the liquid discharge head 3. The first circulation pump (high pressure side) 1001 is connected to a common supply flow path 211 through a filter 221*a*. The first circulation pump (low pressure side) 1002 is connected to a common collecting flow path 212 through a filter 221*b*. A negative pressure control unit 230 is disposed on the downstream side of the liquid discharge head 3. A buffer tank 1003 is disposed on the downstream side of the negative pressure control unit 230. The buffer tank 1003 is connected to the first circulation pumps 1001 and 1002. The buffer tank 1003 is connected to an ink tank 1006 through a replenishment pump 1005. By means of the above configuration, a circulation route is formed in which ink flows into the liquid discharge head 3, flows out from the liquid discharge head 3, and flows into the liquid discharge head 3 again.

The negative pressure control unit 230 includes two pressure regulating mechanisms in which mutually different control pressures are set. A negative pressure control unit 230H that is set to a high pressure side is connected to the common supply flow path 211 inside a liquid discharge unit 300 through a liquid supply unit 220. A negative pressure control unit 230L that is set to a low pressure side is connected to the common collecting flow path 212 inside the liquid discharge unit 300 through the liquid supply unit 220. The pressure inside the common supply flow path 211 is made relatively higher than the pressure inside the common collecting flow path 212 by means of the two negative pressure control units 230H and 230L. As a result, a flow arises that flows from the common supply flow path 211 to the common collecting flow path 212 via individual flow paths 213*a*, an internal flow path of each recording element substrate 10 and individual flow paths 213*b* (see the outline arrows in FIG. 2). The pressure regulating mechanism of the negative pressure control unit 230 performs a similar action to the action of a so-called "back pressure regulator", and controls the pressure on the upstream side thereof within a fixed fluctuation range that is centered on a set pressure. Even if a flow rate fluctuates due to changes in the recording duty when performing recording with the liquid discharge head 3, the negative pressure control unit 230 controls pressure fluctuations on the upstream side of the negative pressure control unit 230 (that is, the liquid discharge unit 300 side) to within the aforementioned fluctuation range.

A second circulation pump 1004 operates as a negative pressure source that decreases the pressure on the downstream side of the negative pressure control unit 230. The second circulation pump 1004 also pressurizes the buffer tank 1003. Thereby, the influence of the water head pressure of the buffer tank 1003 can be suppressed, and it is therefore possible to broaden the range of choices with respect to the layout of the buffer tank 1003 in the liquid discharge apparatus 1. Instead of the second circulation pump 1004, it is also possible to apply, for example, a water head tank that is arranged so as to have a predetermined water head difference with respect to the negative pressure control unit 230.

(Description of Structure of Liquid Discharge Head)

Figure 3A:
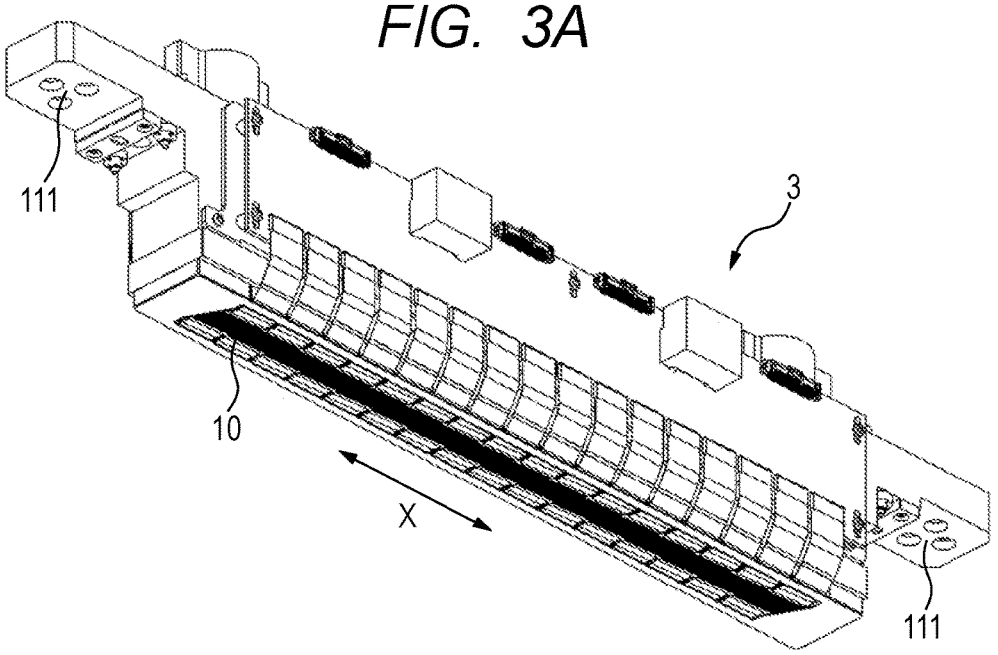
FIGS. 3A and 3B are oblique perspective views of a liquid discharge head according to one exemplary embodiment of the present invention.
Figure 3B:
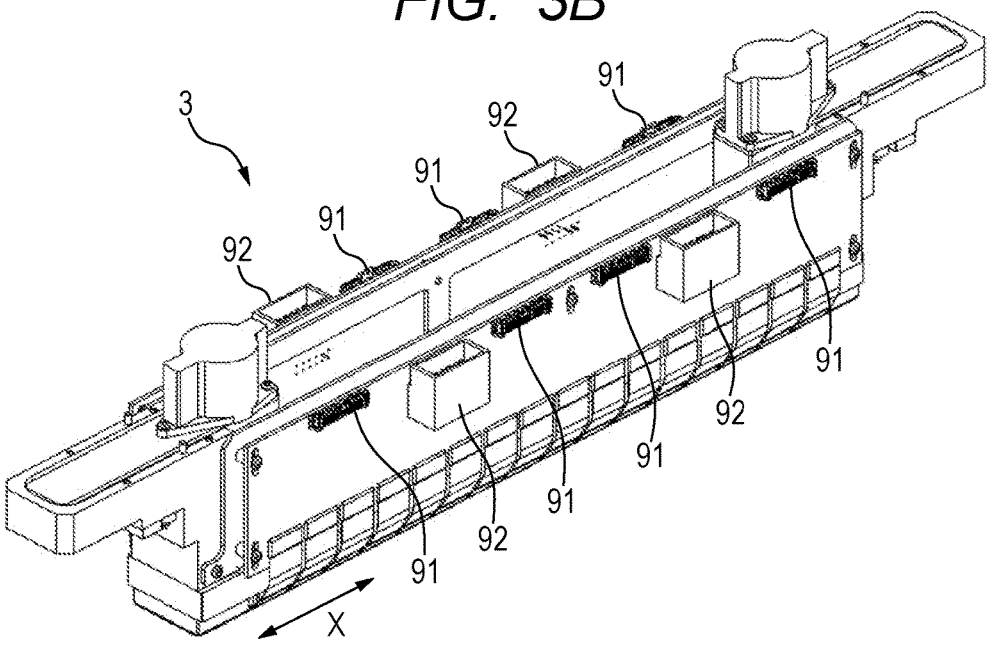

The structure of the liquid discharge head 3 will now be described. FIG. 3A is an oblique perspective view of the liquid discharge head 3 according to the present exemplary embodiment as seen from the discharge port side. FIG. 3B is an oblique perspective view of the liquid discharge head 3 as seen from the opposite side to the discharge ports. As described above, the liquid discharge head 3 is a line-type recording head according to the inkjet system that discharges ink of a single color. The liquid discharge head 3 includes 16 recording element substrates 10 that are arranged in one row in a straight line along the first direction X. The liquid discharge head 3 includes liquid connection portions 111, signal input terminals 91 and power supply terminals 92. The signal input terminals 91 and the power supply terminals 92 are arranged on both sides of the liquid discharge head 3. Thereby, voltage reductions and signal transmission delays are decreased in wiring portions of the recording element substrates 10.

Figure 4:
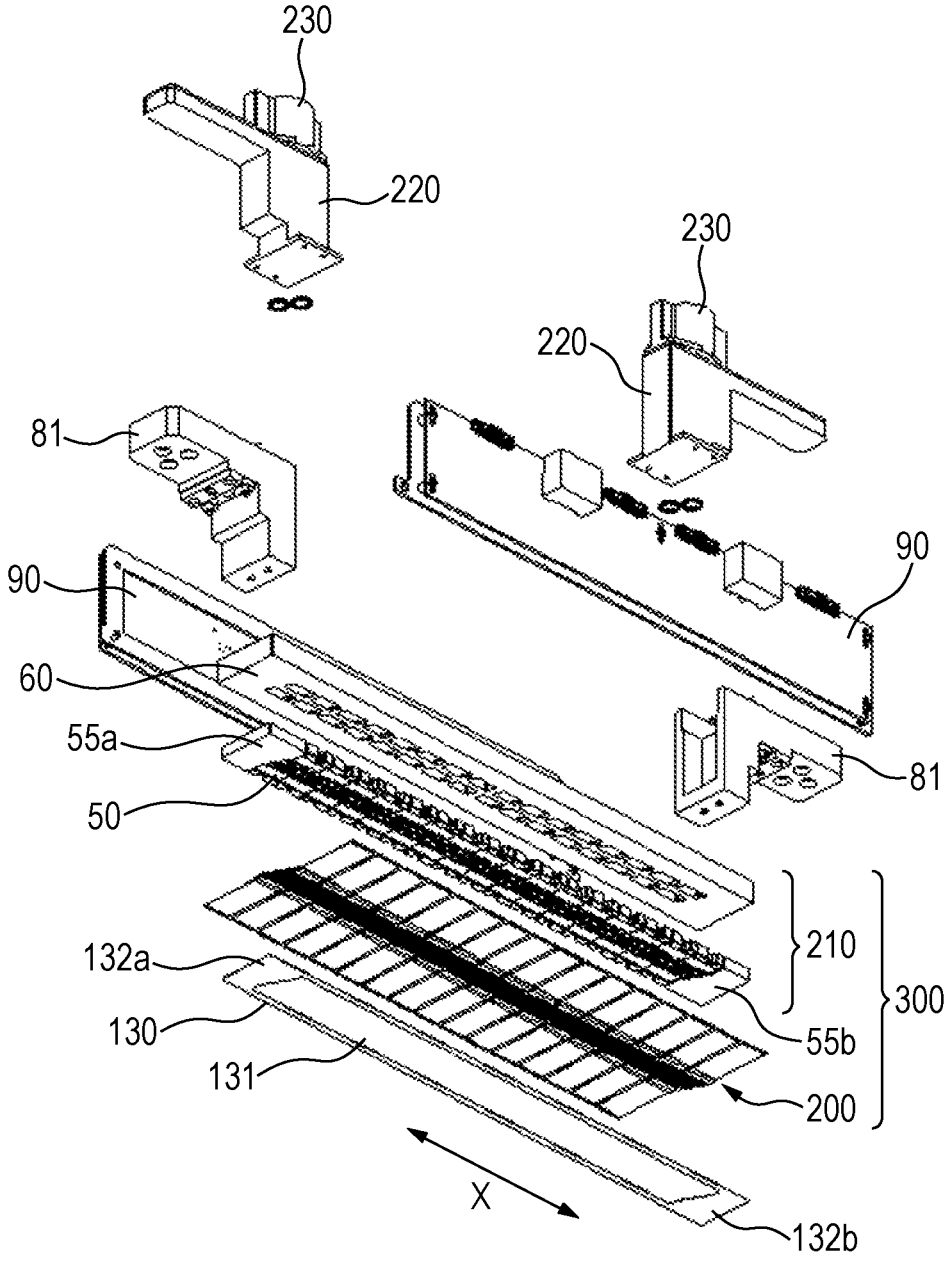
FIG. 4 is an exploded perspective view of the liquid discharge head shown in FIGS. 3A and 3B.

FIG. 4 is an exploded perspective view of the liquid discharge head 3, which illustrates the liquid discharge head 3 in a manner in which the respective components or units constituting the liquid discharge head 3 are divided according to the respective functions thereof. The liquid discharge unit 300 has a flow path member 210 and a plurality of discharge modules 200. The flow path member 210 includes a first flow path member 50 and a second flow path member 60 that is laminated above the first flow path member 50. The second flow path member 60 contains the common supply flow path 211 and the common collecting flow path 212. Ink that is supplied from the liquid supply unit 220 is distributed from the common supply flow path 211 of the flow path member 210 to each discharge module 200. Ink that flows out from the respective discharge modules 200 is returned from the common collecting flow path 212 of the flow path member 210 to the liquid supply unit 220. The second flow path member 60 has a function of forming the common supply flow path 211 and the common collecting flow path 212, and also has a function of increasing the rigidity of the liquid discharge head 3. Therefore, preferably the second flow path member 60 is formed of a material that has adequate corrosion resistance with respect to ink and also has a high degree of mechanical strength, such as SUS, Ti or alumina.

A pair of liquid discharge unit supporting portions 81 are connected to both ends of the second flow path member 60. The liquid supply unit 220, which includes the negative pressure control unit 230, and an electric wiring board 90 are joined to the liquid discharge unit supporting portions 81. The filter 221*a* and the filter 221*b* (see FIG. 2) are contained inside each of the two liquid supply units 220. The negative pressure control unit 230H that is on the high pressure side is arranged at one end of the liquid discharge head 3, and the negative pressure control unit 230L that is on the low pressure side is arranged at the other end of the liquid discharge head 3. Consequently, the flow of ink in the common supply flow path 211 and the flow of ink in the common collecting flow path 212, which extend in the first direction X, are counter flows with respect to each other. Since heat exchange is promoted between the common supply flow path 211 and the common collecting flow path 212, it is difficult for temperature differences to arise between the plurality of recording element substrates 10 that are provided along the common supply flow path 211 and the common collecting flow path 212, and hence it is difficult for an unevenness in recording that is caused by a temperature difference to arise.

A discharge port forming face 24 (see FIGS. 6A and 6B) of the recording element substrate 10 is covered by a cover member 130. The cover member 130 has an opening 131 through which the plurality of discharge ports are exposed. At a time that ink is not being discharged, evaporation of ink from the discharge ports is prevented by causing a cap member 1007 to contact against the cover member 130. In a state in which the cap member 1007 is attached to the liquid discharge head 3, air bubbles or thickened ink can be sucked and removed from inside the discharge ports by using a pump to generate a negative pressure in a space 1010 (see FIG. 12A) that is enclosed by the cap member 1007 and the liquid discharge head 3. The configuration of the cover member 130 is described in detail later.

Figure 5A:
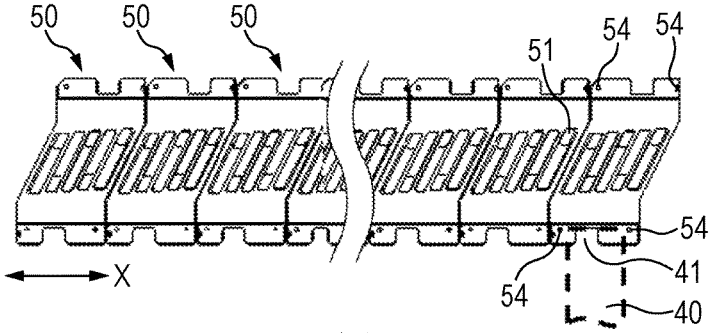
FIGS. 5A, 5B, 5C, 5D and 5E are plan views of first and second flow path members.
Figure 5B:
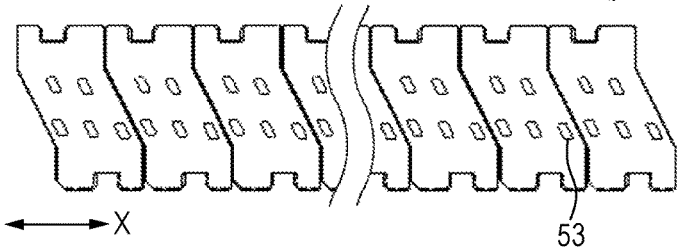

FIG. 5A illustrates the surface of the first flow path member 50 on which the discharge module 200 is mounted, and FIG. 5B illustrates a rear face which the second flow path member 60 contacts against of the first flow path member 50. A plurality of the first flow path members 50 are provided, and the respective first flow path members 50 correspond to the respective discharge modules 200. The plurality of first flow path members 50 are arranged adjacent to each other. Because a plurality of the first flow path members 50 are provided, it is easy to correspond to liquid discharge heads 3 of various lengths, and this configuration is particularly favorable with respect to a liquid discharge head formed with a comparatively long length that corresponds to the length of, for example, a B2 size recording medium or a recording medium having a size that is larger than B2. Communication openings 51 of the first flow path members 50 fluidly communicate with the discharge modules 200, and individual communication openings 53 of the first flow path members 50 fluidly communicate with communication openings 61 of the second flow path member 60.

Figure 5C:
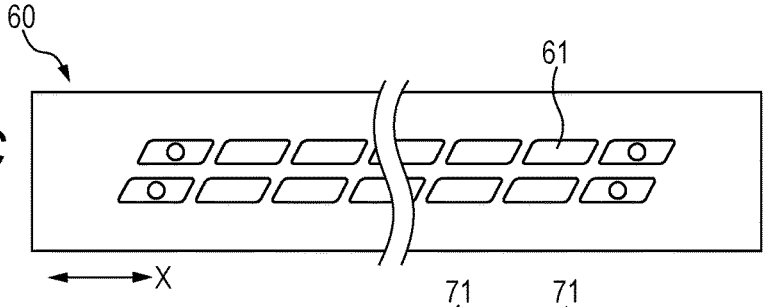
Figure 5D:
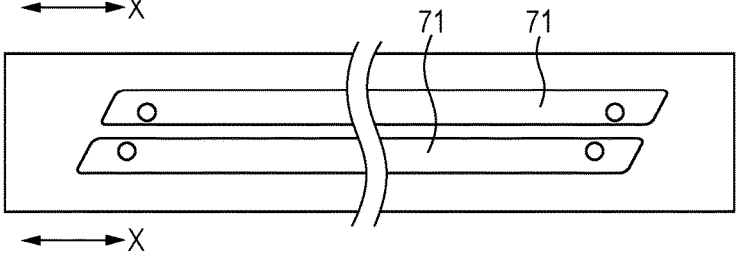
Figure 5E:
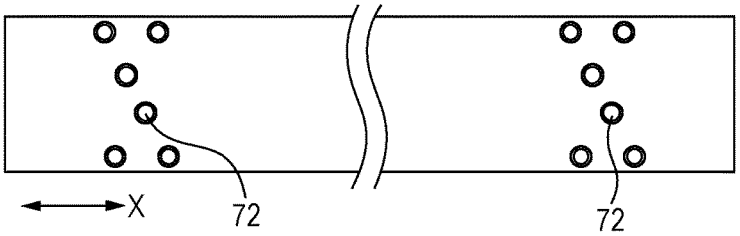

FIG. 5C illustrates a face which the first flow path member 50 contacts against of the second flow path member 60. FIG. 5D illustrates a cross section at a central portion in a thickness direction of the second flow path member 60. FIG. 5E illustrates a face which the liquid supply unit 220 contacts against of the second flow path member 60. One common flow path groove 71 of the second flow path member 60 is the common supply flow path 211, and the other common flow path groove 71 is the common collecting flow path 212. Ink is supplied from one end side in the first direction X of the liquid discharge head 3 towards the other end side.

As described later, electrical wiring members 40 corresponding to each recording element substrate 10 are connected across the entire length in the first direction X of the opening 131 of the cover member 130 to terminals 16 on both sides of the relevant recording element substrate 10. Consequently, if the cover member 130 is pasted directly onto the electrical wiring member 40, it will be difficult to maintain the flatness of the cover member 130. In the present exemplary embodiment, protruding portions 54 that project beyond the electrical wiring member 40 to the cover member 130 side (also see FIG. 6B) are provided on both sides in the first direction X of a connecting portion 41 between each recording element substrate 10 and the electrical wiring member 40 in the first flow path member 50. The cover member 130 is brought into contact with and bonded to the protruding portions 54. As a result, the flatness of the cover member 130 can be enhanced, and the rigidity in the first direction X of the cover member 130 can also be increased. Note that, the dimensions in the first direction X of the electrical wiring member 40 are made smaller than the dimensions in the first direction X of the first flow path member 50.

Figure 6A:
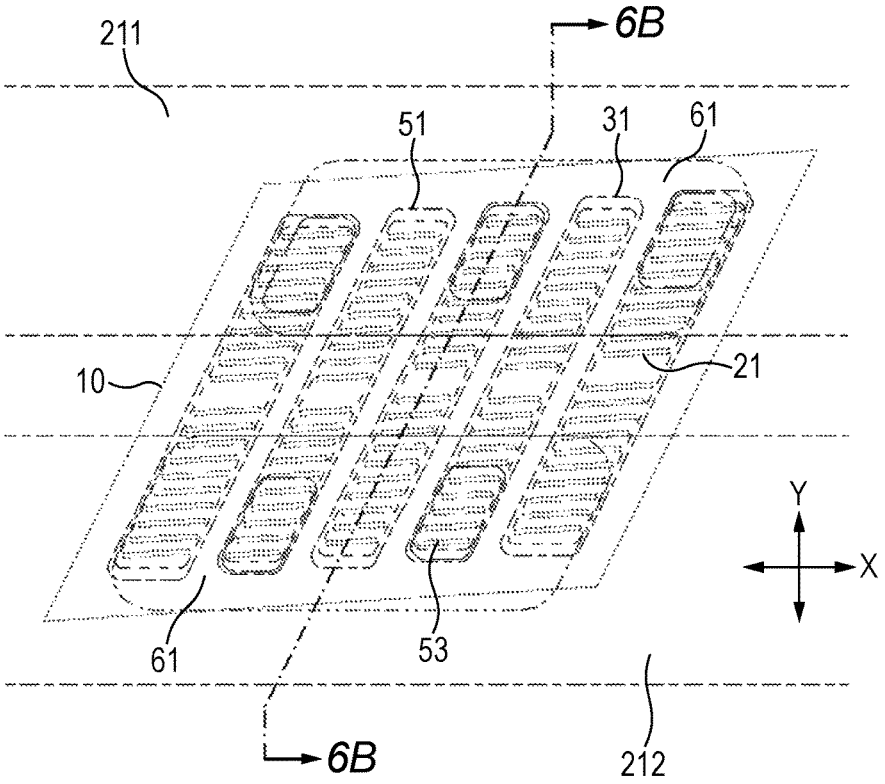
FIGS. 6A and 6B are a perspective diagram and a cross-sectional view illustrating a recording element substrate and ink flow paths in a flow path member.

FIG. 6A is a perspective diagram illustrating flow paths of ink in the recording element substrate 10 and the flow path member 210. A pair of the common supply flow path 211 and the common collecting flow path 212 that extend in the first direction X are provided within the flow path member 210. The communication openings 61 of the second flow path member 60 are connected to individual communication openings 53 of each first flow path member 50. A liquid supply route is formed that communicates from communication openings 72 (see FIG. 5E) of the second flow path member 60 to the communication openings 51 of the first flow path members 50 through the common supply flow path 211. Similarly, a liquid supply route is formed that communicates from communication openings 72 of the second flow path member 60 to the communication openings 51 of the first flow path members 50 through the common collecting flow path 212.

Figure 6B:
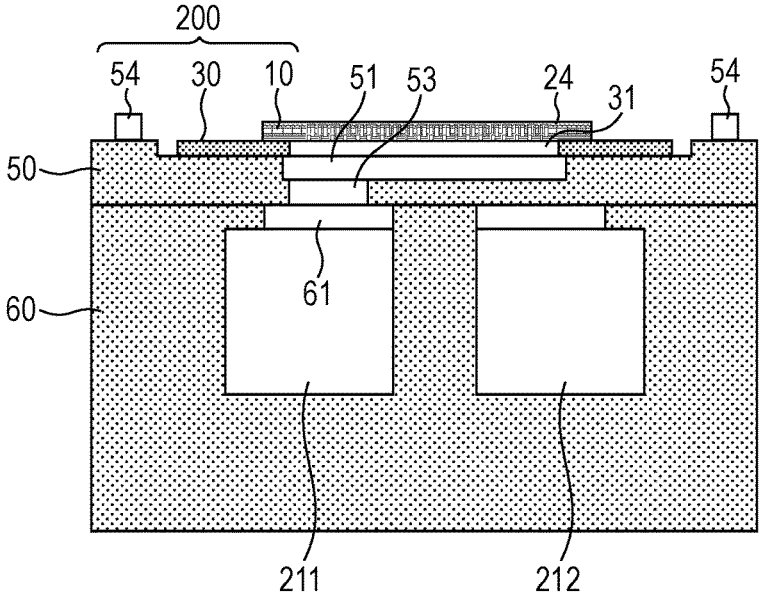

FIG. 6B illustrates a cross section along a line 6B-6B in FIG. 6A. The common supply flow path 211 is connected to the discharge module 200 through the communication openings 61, individual communication openings and the communication openings 51. Although not illustrated in FIG. 6B, the common collecting flow path 212 is connected by a similar route to the discharge module 200. Flow paths that communicate with each discharge port 13 are formed in the respective discharge modules 200 and recording element substrates 10. Some or all of the supplied ink circulates by passing through discharge ports 13 (pressure chambers 23) at which a discharge operation is paused. The face in which the discharge ports 13 of the recording element substrate 10 are formed is the discharge port forming face 24.

(Description of Discharge Module)

Figure 7A:
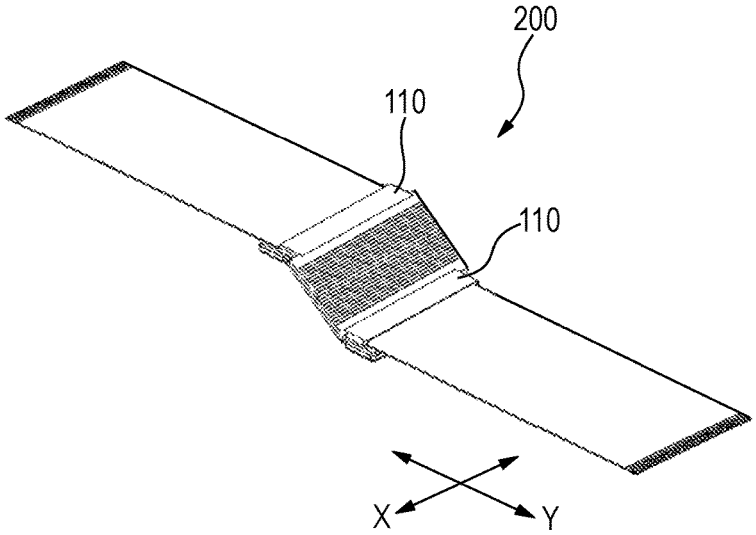
FIGS. 7A and 7B are an oblique perspective view and an exploded perspective view of a discharge module.
Figure 7B:
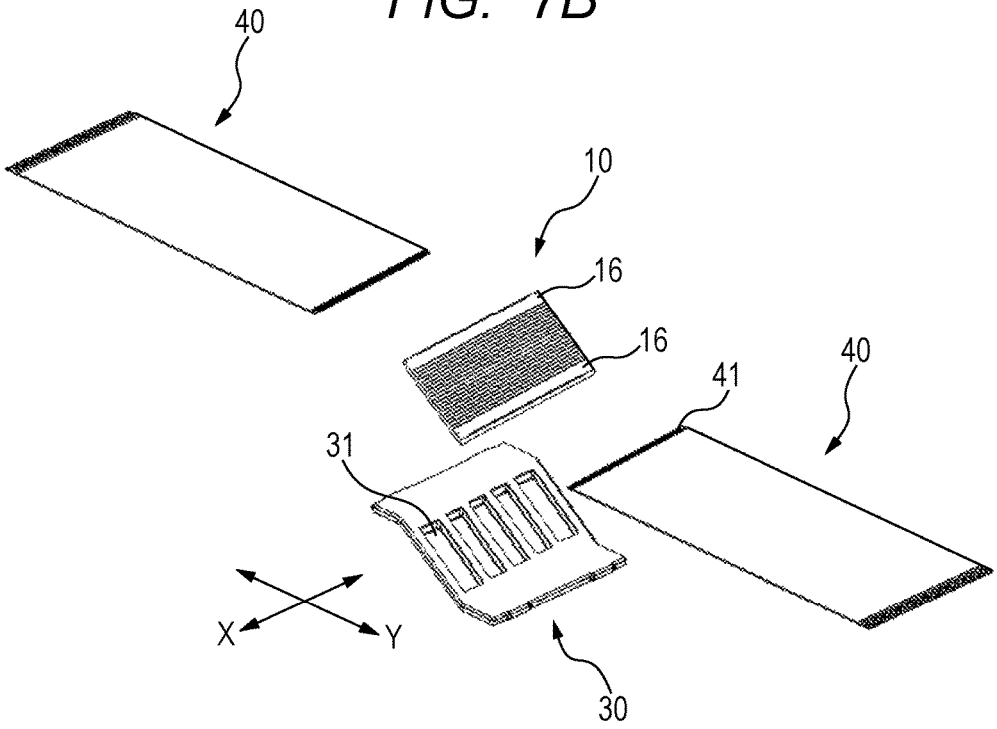

FIG. 7A is an oblique perspective view that illustrates the discharge module 200. FIG. 7B illustrates an exploded view of the discharge module 200. A plurality of terminals 16 are arranged, respectively, along both sides along the first direction X of the recording element substrate 10 (the respective long side portions of the recording element substrate 10). The electrical wiring member (flexible wiring board) 40 is electrically connected to the plurality of terminals 16. A connecting portion between the electrical wiring member 40 and the terminals 16 is covered with a sealant 110. Two of the electrical wiring members 40 are arranged with respect to one recording element substrate 10. This is because 20 discharge port rows are provided in the recording element substrate 10, and therefore there is a large number of wires. By providing the electrical wiring members 40 on both sides of the recording element substrate 10, the maximum wiring distance from the respective terminals 16 to an energy generating element 15 can be shortened, and voltage reductions or signal transmission delays that occur in the internal wiring can be reduced. The recording element substrate 10 is supported by a support member 30. A plurality of liquid communication openings 31 which each extend across all of the discharge port rows are formed in the support member 30.

(Description of Structure of Recording Element Substrate)

Figure 8A:
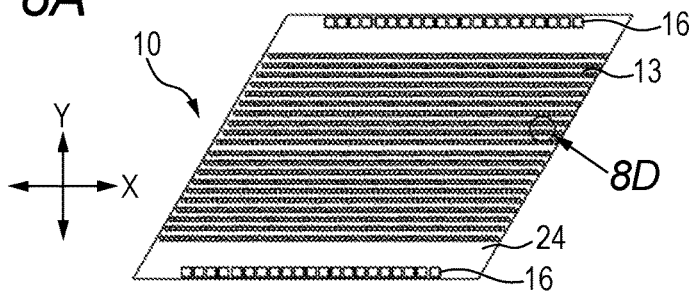
FIGS. 8A, 8B, 8C and 8D are plan views of a recording element substrate.
Figure 8B:
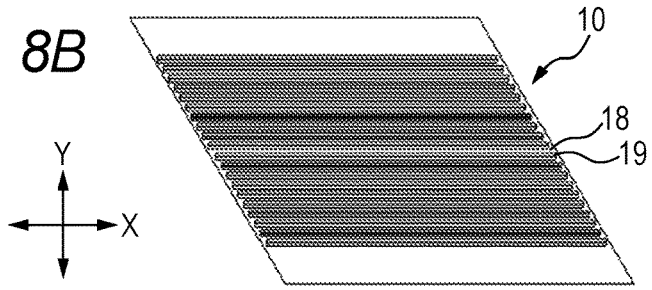
Figure 8C:
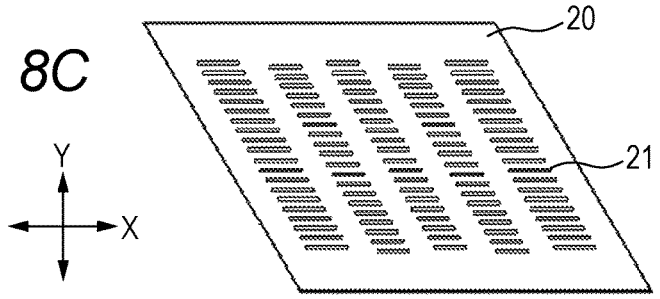
Figure 8D:
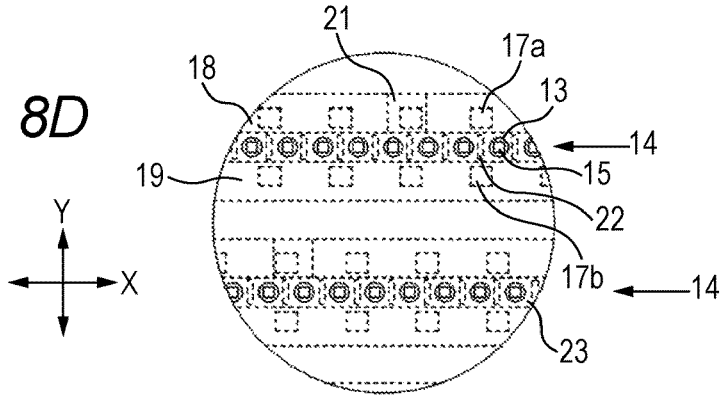

FIG. 8A is a schematic view of the discharge port forming face 24 in which the discharge ports 13 are formed of the recording element substrate 10. FIG. 8B is a schematic view of the rear face of the recording element substrate 10. FIG. 8C is a schematic view of a lid member 20 that covers the recording element substrate 10. FIG. 8D is a partially enlarged view of the recording element substrate 10, which shows a section 8D in FIG. 8A in an enlarged form. Although the recording element substrate 10 has a shape of an approximate parallelogram in which the corners are not right angles, the recording element substrate 10 may be a rectangular shape, a trapezoidal shape or other shape. A plurality of discharge port rows 14 are formed in the recording element substrate 10. A pressure chamber 23 that includes the energy generating element 15 therein is defined by a partition wall 22. The energy generating element 15 is disposed facing the discharge port 13. The energy generating element 15 is a heat generating element that generates thermal energy for causing ink to foam. The energy generating element 15 is electrically connected to the terminal 16 by electric wiring (not shown) that is provided in the recording element substrate 10. The terminal 16 is electrically connected to a control circuit of the liquid discharge apparatus 1 through the electric wiring board 90 and the electrical wiring member 40. The energy generating element 15 generates heat based on electric power that is transmitted from the control circuit and a discharge control signal to thereby boil the ink. The ink is discharged from the discharge port 13 by the force of foam that is generated by the boiling. A liquid supply path 18 and a liquid collecting path 19 are alternately provided along the discharge port row direction in the rear face of the recording element substrate 10. The liquid supply path 18 and the liquid collecting path 19 are flow paths that extend in the discharge port row direction, and communicate with the discharge port 13 through a supply port 17*a* and a collecting port 17*b*, respectively. An opening 21 that communicates with the liquid communication opening 31 of the support member 30 is provided in the lid member 20.

(Description of Positional Relation Between Recording Element Substrates)

Figure 9:
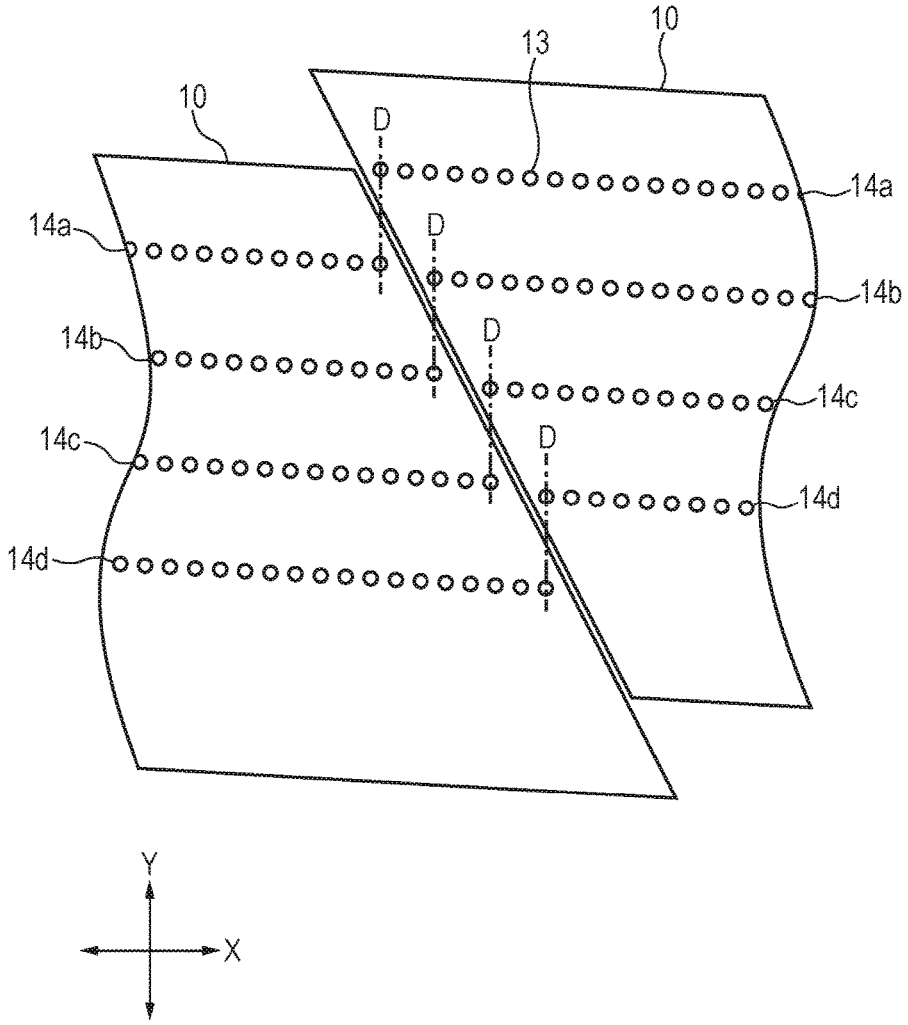
FIG. 9 is an enlarged view of a portion at which two recording element substrates are adjacent to each other.

FIG. 9 is a plan view that illustrates, in a partially enlarged manner, a portion at which recording element substrates are adjacent in two adjoining discharge modules. A plurality of discharge port rows 14*a* to 14*d* are arranged so as to incline slightly with respect to the first direction X. At the portion at which the recording element substrates 10 are adjacent, at least one discharge port 13 of each of the adjacent recording element substrates 10 overlaps in the second direction Y. In FIG. 9, two discharge ports 13 overlap with each other on a line D. By adopting this arrangement, even if a situation arises in which the position of one of the recording element substrates 10 deviates somewhat from a predetermined position, black streaks or white splotches in a recorded image can be made inconspicuous by driving control of an overlapping discharge port 13. In a case where recording is performed by distributing image data among a plurality of discharge port rows as in the present exemplary embodiment, the discharge ports 13 need not be overlapping. Black streaks or white splotches in a recorded image can be made inconspicuous by distributing the image between different discharge port rows among adjacent recording element substrates.

(Description of Cover Member 130)

Figure 10A:
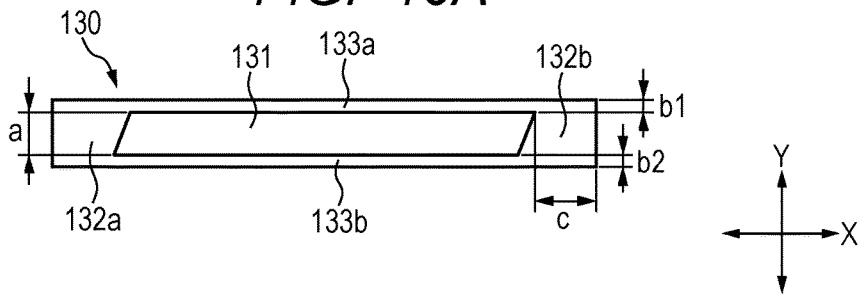
FIGS. 10A, 10B, 10C, 10D and 10E are plan views and cross-sectional views of a cover member.

FIG. 10A is a plan view that represents a first form of the cover member 130 of the present exemplary embodiment. Although a cross-sectional view is not shown in the drawings, the cover member 130 is tabular and has a uniform thickness. The cover member 130 has two end regions 132*a* and 132*b* that are located at both ends in the first direction X, and two beam portions 133*a* and 133*b* that extend in the first direction X and connect the two end regions together (end region 132*a* and end region 132*b*). The end regions 132*a* and 132*b* and the beam portions 133*a* and 133*b* form an abutting face of the cover member 130 with respect to the cap member 1007, and also form the single opening 131 that exposes a plurality of the recording element substrates 10 and thus a plurality of the discharge ports 13. In order to shorten the dimension of the liquid discharge head 3 in the first direction X, a beam or the like is not provided at boundaries between the recording element substrates 10 in the opening 131, and the opening 131 is open over the entire printing width onto a recording medium. Preferably, the length in the first direction X of the opening 131 is longer than the printing width in the first direction X onto the recording medium.

The abutting face of the cover member 130 with respect to the cap member 1007 is formed flat, and thus the airtightness when the cap member 1007 is contacted against the cover member 130 in a non-discharging state is enhanced. The cover member 130 also flattens the face which opposes to the recording medium of the liquid discharge head 3, and thus reduces fluctuations in airflows that accompany the conveyance of the recording medium or the discharge of ink, thereby enhancing the impact accuracy of the ink.

The main specifications of the cover member 130 are defined hereunder.

a [mm]: width of opening 131 in second direction Y b1 [mm], b2 [mm]: width of two beam portions 133*a* and 133*b* in second direction Y c [mm]: minimum length of end regions 132*a* and 132*b* in first direction X E [GPa]: modulus of longitudinal elasticity of cover member 130 t [mm]: thickness of cover member 130

Although in the present exemplary embodiment the opening 131 is a parallelogram in which the corners are not right angles and the end regions 132*a* and 132*b* of both corners have the same shape, the end regions 132*a* and 132*b* may have different shapes from each other. In such a case, "c" is defined as the smaller value among the minimum length in the first direction X of one of the end regions, 132*a*, and the minimum length in the first direction X of the other of the end regions, 132*b*.

Preferably, the widths b1 and b2 of the beam portions 133*a* and 133*b* are equal to or greater than 5 mm so that adequate airtightness is obtained when the cap member 1007 is caused to contact against the cover member 130, and preferably the widths are equal to or less than 10 mm so as to shorten the width in the recording medium conveyance direction of the liquid discharge head 3. Although the respective dimensions of the widths b1 and b2 are the same, the widths may be different from each other within this range. Further, preferably, a>b1 and a>b2.

In a configuration in which the recording element substrates 10 are arranged in a staggered shape, it is sufficient to provide an opening in the cover member at only a place at which the recording element substrates 10 are arranged. In this case, the width in the second direction Y of the opening can be made partially larger than the width in the second direction Y of the recording element substrate 10. In the staggered arrangement system described in Japanese Patent Application Laid-Open No. 2016-000489, the opening ratio of the cover member 130 is of the order of 50%, and it is comparatively easy to secure the rigidity of the cover member 130. On the other hand, in a case where the recording element substrates 10 are arranged in an inline shape, because the beam portions 133*a* and 133*b* have a longitudinal shape in the first direction X, the widths b1 and b2 of the beam portions 133*a* and 133*b* are extremely small across the entire length in the first direction X. The proportion of the cover member 130 that is occupied by the opening 131 is extremely large, and the rigidity of the cover member 130 is liable to decrease. If the amount of rigidity of the cover member 130 is small, the possibility that a deformation will occur during assembly or when the cap member 1007 is caused to contact against the cover member 130 (at the time of capping) increases. Therefore, in the present exemplary embodiment, the rigidity of the cover member 130 is enhanced by lengthening the minimum length c in the first direction X of the end regions 132*a* and 132*b*.

The rigidity in the second direction Y of the end regions 132*a* and 132*b* of the cover member 130 is given by the following expression based on beam theory.

$$E\frac{ct^3}{a^4} \qquad \text{(Mathematical Expression 1)}$$

Where, "rigidity" is "the reciprocal of a deflection amount when a unit load is applied". Although (Mathematical Expression 1) determines the rigidity based on a model in which a uniformly distributed load is applied to a straight beam having a rectangular cross section that is simply supported at both ends, in the case of fixed end support or a concentrated load also, the coefficients merely change, and (Mathematical Expression 1) still holds. In the liquid discharge apparatus 1, when separating the cap member 1007 from the cover member 130, a load that is applied to the cover member 130 is of the order of several kilograms. In a case where the cover member 130 that was made from stainless steel (E =200 GPa) and in which a =25 mm and t=0.3 mm was subjected to the aforementioned force, adequate rigidity was obtained when c was equal to or greater than 10 mm, and adequate rigidity was not obtained when c was less than 10 mm. Accordingly, when the material (modulus of longitudinal elasticity E) and dimensions a and t of the cover member 130 are changed, based on (Mathematical Expression 1), it is desirable that the following expression is satisfied:

$$c \geq \frac{10\left(\frac{a}{25}\right)^4}{\left(\frac{t}{0.3}\right)^3\left(\frac{E}{200}\right)}. \qquad \text{(Mathematical Expression 2)}$$

The end regions 132*a* and 132*b* of the cover member 130 are bonded to the first flow path member 50 by an adhesive. That is, as shown in FIG. 4, two ends 55*a* and 55*b* in the first direction X of the first flow path member 50 are formed in substantially the same shape as the end regions 132*a* and 132*b* of the cover member 130, and the end regions 132*a* and 132*b* are fixed to the two ends 55*a* and 55*b* by adhesive. The rigidity in the first direction X of the cover member 130 can be determined by applying beam theory similarly to when determining the rigidity in the second direction Y. However, because a boundary condition of the beam portions 133*a* and 133*b* changes depending on the fixing state of the end regions 132*a* and 132*b*, the rigidity in the first direction X of the cover member 130 changes in a range up to approximately a fivefold value. That is, in a case where the adhesive length in the first direction X of the end regions 132*a* and 132*b* is short, the state of the beam portions 133*a* and 133*b* is close to a simply supported state and the rigidity decreases, while in a case where the adhesive length is sufficiently long, the state of the beam portions 133*a* and 133*b* is close to a fixed-end supporting state and the rigidity increases. To achieve a condition that is close to a fixed-end supporting state, it is preferable that the value of the dimension c is made 8 mm or more.

Figure 11A:
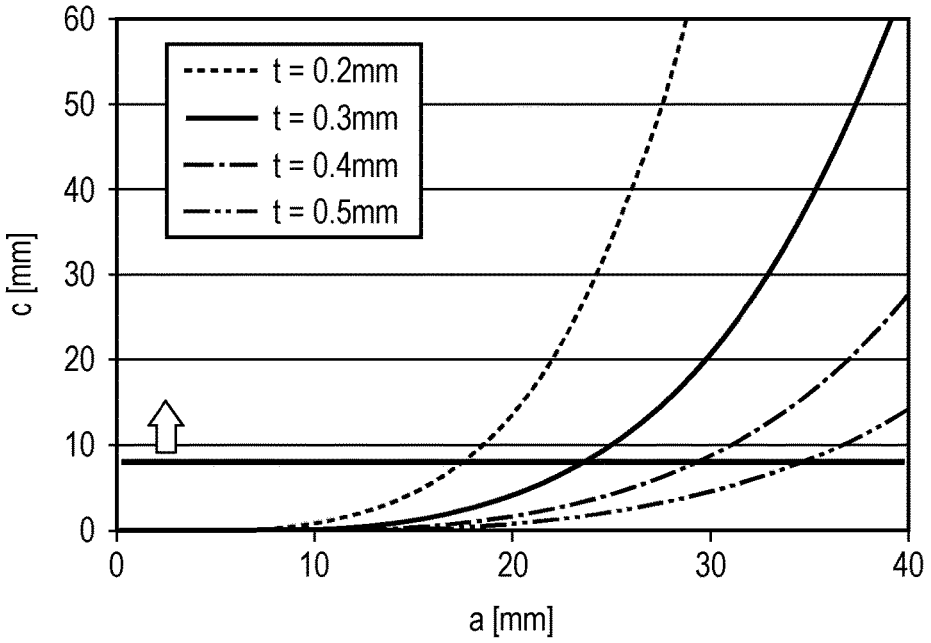
FIGS. 11A and 11B are graphs illustrating a relation between an opening length a of a cover member and a minimum length c of an end region.
Figure 11B:
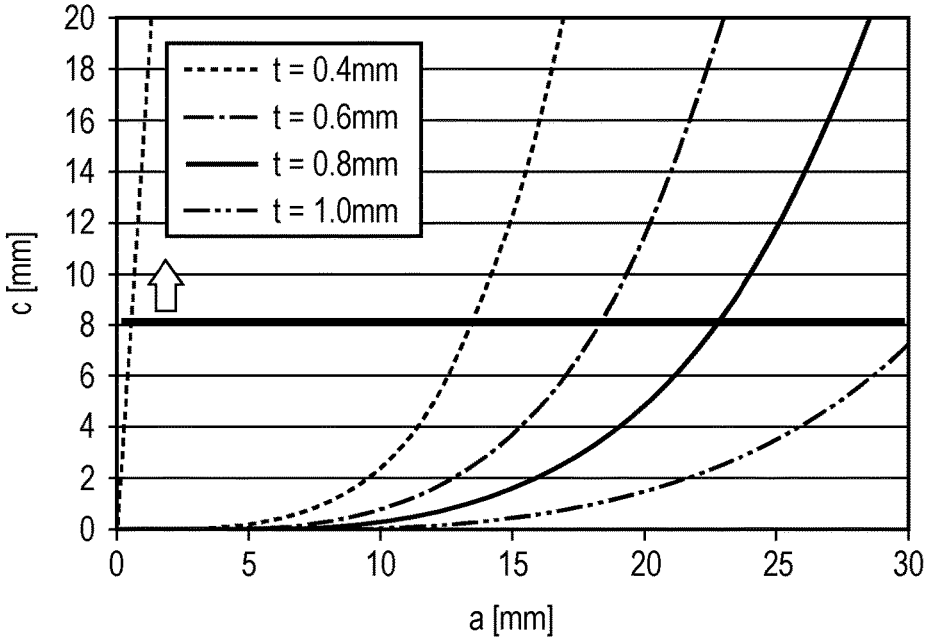

FIG. 11A illustrates the relation between the width a of the opening 131 and a required minimum value of c that is calculated based on Mathematical Expression (2). The material of the cover member 130 is assumed to be stainless steel (E=200 GPa), and the thickness t is taken as a parameter. For example, when t=0.3 mm and a=30 mm, preferably c is made 20 mm or more. Sufficient rigidity is not obtained when c is 15 mm. FIG. 11B illustrates the relation between the width a of the opening 131 and a required minimum value of c that is calculated based on Mathematical Expression (2) in a case where a resin molding material (E=9 GPa) is adopted as the material of the cover member 130. For example, when t=0.6 mm and a=20 mm, preferably c is made 12 mm or more. On the other hand, when t=0.8 mm and a=17 mm, although c satisfies Mathematical Expression (2) when c is 3 mm or more, because the state of the end regions 132*a* and 132*b* is close to a fixed-end supporting state, preferably c is made 8 mm or more. Note that, in FIGS. 11A and 11B, a region at which c ≥8 mm or more is indicated by an outline arrow.

Figure 10B:
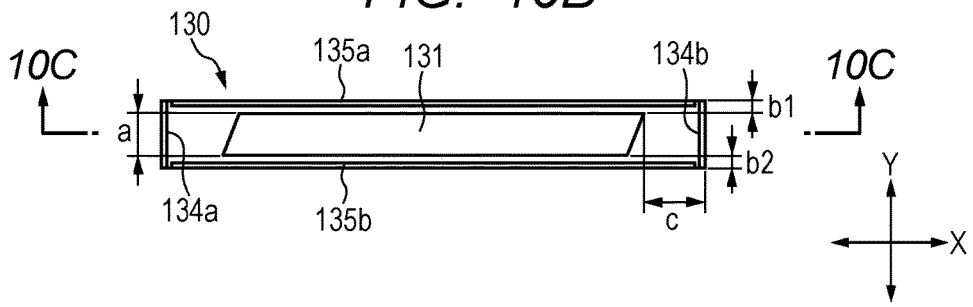
Figure 10C:
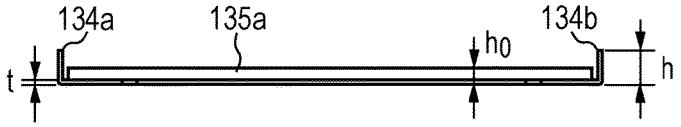

FIG. 10B is a plan view of the cover member 130 according to a second exemplary embodiment. FIG. 10C is a cross-sectional view along a line 10C-10C in FIG. 10B. The cover member 130 has first bent portions 134*a* and 134*b* that bend from respective ends in the first direction X of the end regions 132*a* and 132*b* toward the recording element substrate 10. Further, the cover member 130 has second bent portions 135*a* and 135*b* that bend from respective outside edges on an opposite side to the opening 131 of the beam portions 133*a* and 133*b* toward the recording element substrate 10. Although in the present exemplary embodiment the first bent portions 134*a* and 134*b* are formed across the entire length of the respective ends of the end regions 132*a* and 132*b*, a configuration may also be adopted in which the first bent portions 134*a* and 134*b* are formed partially with respect to the entire length of the respective ends of the end regions 132*a* and 132*b*. Similarly, although the second bent portions 135*a* and 135*b* are formed across the entire length of the beam portions 133*a* and 133*b*, the second bent portions 135*a* and 135*b* may be formed partially with respect to the entire length of the respective beam portions 133*a* and 133*b*. A configuration in which only either one of the first bent portions 134*a* and 134*b* is formed may be adopted, and a configuration in which only either one of the second bent portions 135*a* and 135*b* is formed may also be adopted.

In order to avoid interference with the electrical wiring members 40 that are lead out from the long sides on both sides of the recording element substrate 10, a height $h_0$ of the second bent portions 135*a* and 135*b* is made lower than a height h of the first bent portions 134*a* and 134*b*. Because the first bent portions 134*a* and 134*b* do not interfere with the electrical wiring member 40, the rigidity of the cover member 130 can be increased by making the height h higher than the height $h_0$. In a case where the electrical wiring member 40 is lead out from only one side of the recording element substrate 10, the height of the bent portion that is connected to the beam portion on the side from which the electrical wiring member is lead out may be made $h_0$, and the height of the bent portion that is connected to the beam portion on the side from which the electrical wiring member is not lead out may be made h. Thus, the rigidity of the cover member 130 can be further enhanced.

With respect to a peeling force that arises when separating the cap member 1007 that is described next, because a shearing force acts on the first bent portions 134*a* and 134*b* and the second bent portions 135*a* and 135*b*, the cover member 130 can be made difficult to peel off. In particular, since the second bent portions 135*a* and 135*b* are formed along the long sides of the cover member 130, this configuration is effective for countering the peeling force that arises when separating the cap member 1007 from the cover member 130.

Figure 10D:
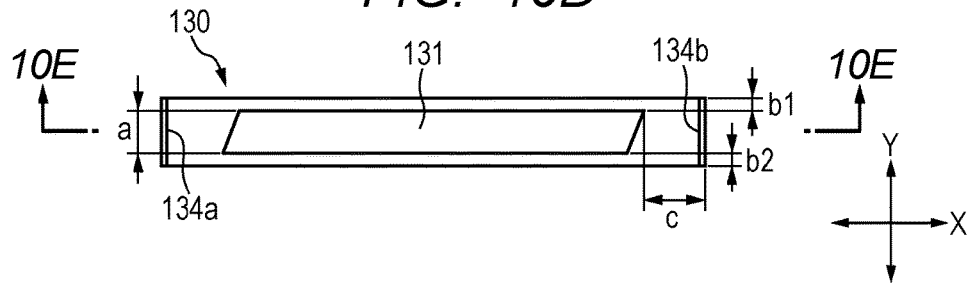
Figure 10E:
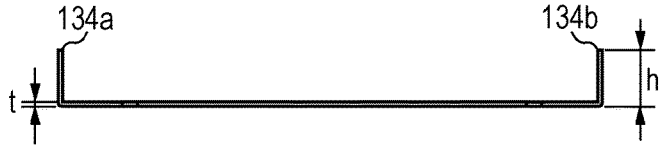

FIG. 10D is a plan view of the cover member 130 according to a modification of the second exemplary embodiment. FIG. 10E is a cross-sectional view along a line 10E-10E in FIG. 10D. In the present modification, only the first bent portions 134*a* and 134*b* are provided, and the second bent portions 135*a* and 135*b* are not provided. This kind of modification can be used in a case where it is difficult to prevent interference with the electrical wiring members 40 that are led out from the long sides on both sides of the recording element substrate 10. Note that, according to the configurations in which at least either one of the first bent portions 134*a* and 134*b* are provided that are shown in the second exemplary embodiment and the modification thereof, sufficient rigidity can be obtained with respect to the cover member even if the dimensional relation shown in Mathematical Expression (2) is not satisfied. In this case, because the dimension c can be reduced to a size that is necessary for contact by the cap member 1007, it is possible to reduce the dimension in the first direction X of the liquid discharge head.

In addition, although not illustrated in the drawings, the first bent portions 134*a* and 134*b* may be extended and bonded to a side wall of the first flow path member 50 or the second flow path member 60. Thereby, the end regions 132*a* and 132*b* can be more securely supported by the flow path member 210 and the rigidity of the cover member 130 can be enhanced.

(Capping Operation)

Figure 12A:
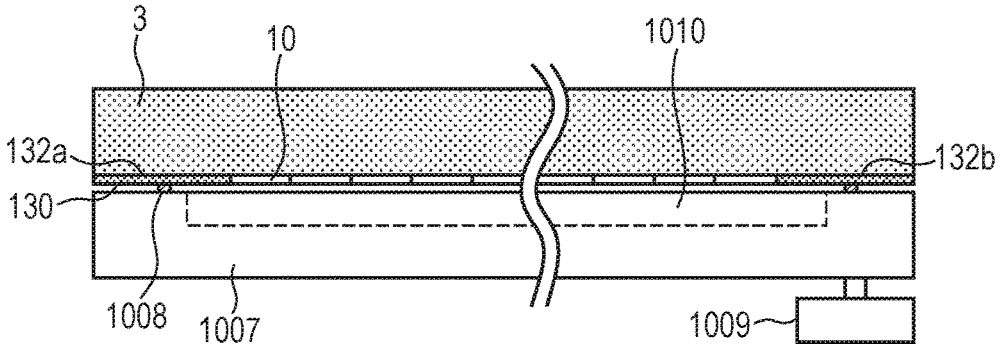
FIGS. 12A, 12B and 12C are schematic views illustrating a separation operation of a cap member.
Figure 12B:
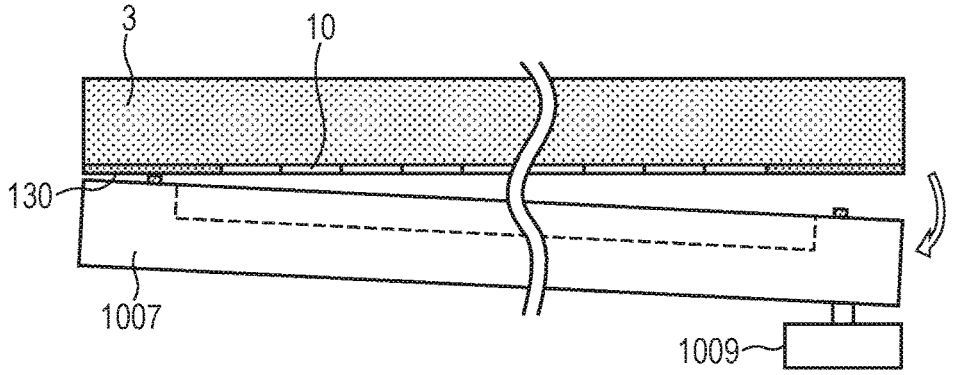
Figure 12C:
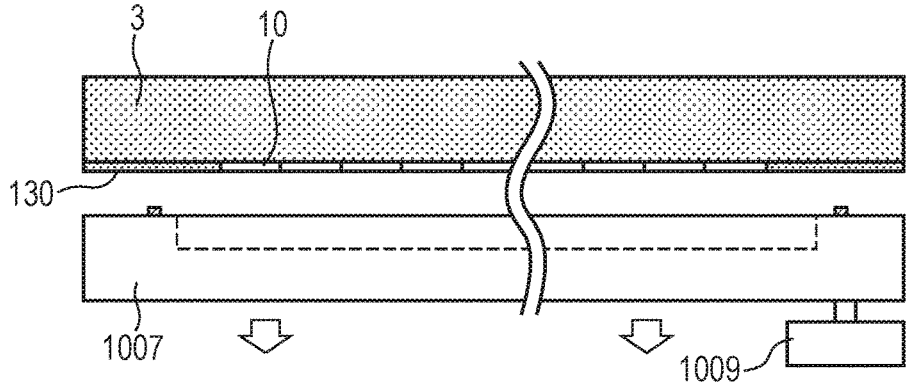

As described above, since the cap member 1007 butts against the flat cover member 130 and continuously covers the entire region at which the discharge ports 13 are formed of the discharge port forming face 24, the airtightness of the cap member 1007 is enhanced. On the other hand, when separating the cap member 1007 from the cover member 130, a sealing material 1008 at the tip of the cap member 1007 adheres to the cover member 130 and in some cases a large peeling force acts thereon. In particular, in the liquid discharge head 3 of the present exemplary embodiment, because the widths b1 and b2 of the beam portions 133*a* and 133*b* are small, the peeling force is liable to concentrate at the beam portions 133*a* and 133*b*. Therefore, as illustrated in FIGS. 12A to 12C, a tilting mechanism 1009 is provided that tilts at least one of the cap member 1007 and the liquid discharge head 3 when separating the cap member 1007 from the cover member 130. In the present exemplary embodiment, a configuration is adopted so that the cap member 1007 tilts relative to the liquid discharge head 3, and the end region 132*b* is thus separated from the cap member 1007 before the other end region 132*a*. Consequently, a peeling force that arises when separating the cap member 1007 from the cover member 130 can be surely received at the end regions 132*a* and 132*b* which have a high degree of rigidity. The tilting mechanism 1009 may also be a mechanism that causes the liquid discharge head 3 to tilt, or may be a mechanism that causes both the cap member 1007 and the liquid discharge head 3 to tilt.

According to the present invention, a liquid discharge head can be provided which includes a cover member having a high degree of rigidity and which facilitates miniaturization.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-097942, filed May 16, 2016 which is hereby incorporated by reference herein in its entirety.

What is claimed is:

1. A liquid discharge head comprising:

a recording element substrate having a discharge port forming face in which a plurality of discharge ports which form at least one row and which discharge a liquid are formed; and a cover member which has a longitudinal shape in a first direction and which covers a part of the discharge port forming face, wherein the cover member comprises:

two end regions being located at two ends in the first direction, and two beam portions which extend in the first direction and connect the two end regions together and which, together with the two end regions, form a single opening that exposes the plurality of discharge ports, and wherein when a width of the opening in a second direction that is orthogonal to the first direction is denoted as a [mm], a minimum length in the first direction of the end regions is denoted as c [mm], a modulus of longitudinal elasticity of the cover member is denoted as E [GPa], and a thickness of the cover member is denoted as t [mm], the following expression is established:

$$c \geq \frac{10\left(\frac{a}{25}\right)^4}{\left(\frac{t}{0.3}\right)^3\left(\frac{E}{200}\right)}.$$

2. The liquid discharge head according to claim 1, wherein c≥8 mm.

3. The liquid discharge head according to claim 1, wherein when widths in the second direction of the two beam portions are denoted as b1 and b2, respectively, a>b1 and a>b2.

4. The liquid discharge head according to claim 3, wherein the widths b1 and b2 are each 5 mm or more and 10 mm or less.

5. The liquid discharge head according to claim 1, wherein a plurality of the recording element substrates are arranged in a row in the first direction.

6. The liquid discharge head according to claim 5, wherein the second direction is along a conveyance direction of a recording medium, and a length in the first direction of the opening is longer than a printing width in the first direction.

7. The liquid discharge head according to claim 5, wherein two electrical wiring members that supply electric power for discharging liquid are connected to two sides of each recording element substrate, the two sides opposing the beam portions.

8. The liquid discharge head according to claim 7, further comprising:

a flow path member which is located on an opposite side to the cover member of each recording element substrate, and in which a flow path that supplies the liquid to each recording element substrate is formed, wherein the flow path member comprises, on both sides in the first direction of a connecting portion between each recording element substrate and the electrical wiring member, a protruding portion that projects beyond the electrical wiring member, the cover member being bonded to the protruding portion.

9. The liquid discharge head according to claim 1, wherein the cover member comprises a first bent portion that bends from an end in the first direction of at least one of the end regions toward the recording element substrate.

10. The liquid discharge head according to claim 9, wherein the cover member has a second bent portion which bends from at least one of the beam portions toward the recording element substrate and which is lower than the first bent portion.

11. The liquid discharge head according to claim 1, further comprising:

a flow path member which is located on an opposite side to the cover member of the recording element substrate, and in which a flow path that supplies the liquid to each recording element substrate is formed, wherein the cover member has a bent portion that bends from an end in the first direction of at least one of the end regions toward the recording element substrate, the bent portion being bonded to a side wall of the flow path member.

12. The liquid discharge head according to claim 1, further comprising:

an element that generates energy that is utilized for discharging the liquid, and a pressure chamber having the element therein, wherein the liquid inside the pressure chamber is circulated between the inside of the pressure chamber and outside of the pressure chamber.

13. A liquid discharge apparatus, comprising:

a liquid discharge head; and a cap member, wherein the liquid discharge head comprises:

a recording element substrate having a discharge port forming face in which a plurality of discharge ports which are arranged in a predetermined direction and which discharge a liquid are formed, and a cover member which has a longitudinal shape in a first direction and which covers a part of the discharge port forming face, wherein the cover member comprises:

two end regions being located at two ends in the first direction, two beam portions which extend in the first direction and connect the two end regions together and which, together with the two end regions, form one opening that exposes the plurality of discharge ports, and a bent portion that bends from an end in the first direction of at least one of the end regions toward the recording element substrate, and wherein the cap member comes into contact with the cover member along the two end regions and the two beam portions and covers the plurality of discharge ports.

14. The liquid discharge apparatus according to claim 13, further comprising a tilting mechanism that, at a time of separating the cap member from the cover member, tilts at least one of the cap member and the liquid discharge head so that the cap member separates from one of the end regions of the cover member before the cap member separates from the other of the end regions of the cover member.

* * * * *